United States Patent [19]

Hartley

[11] 3,954,299

[45] May 4, 1976

[54] LONGWALL MINING MACHINE WITH PIVOTAL BODY ADJUSTMENT

[75] Inventor: Dennis Hartley, Burton-on-Trent, England

[73] Assignee: Coal Industry (Patents) Limited, London, England

[22] Filed: Feb. 10, 1975

[21] Appl. No.: 548,785

[30] Foreign Application Priority Data

Apr. 5, 1974 United Kingdom ..... 15246/74

[52] U.S. Cl. ..... 299/1; 299/43; 299/54

[51] Int. Cl.² ..... E21C 35/06

[58] Field of Search ..... 299/1, 42, 43, 54

[56] References Cited

UNITED STATES PATENTS 3,854,775 12/1974 Anderson ..... 299/43

FOREIGN PATENTS OR APPLICATIONS 1,400,211 4/1965 France ..... 299/43

*Primary Examiner*—Ernest R. Purser

*Attorney, Agent, or Firm*—Stevens, Davis, Miller & Mosher

[57] ABSTRACT

A ranging drum mining machine has its cutting end gearbox pivotally mounted in trunnions for pivotal movement about an axis transverse to the axis of pivotal movement of the ranging arm.

9 Claims, 3 Drawing Figures

LONGWALL MINING MACHINE WITH PIVOTAL BODY ADJUSTMENT

This invention relates to mining machines and in particular the invention relates to so called ranging arm mining machines which have at least one cutter head-carrying arm pivotally mounted on the machine body and which in use traverse to and fro along conveyors extending along longwall faces with the cutter heads winning mineral from the working faces.

It is known for the cutter head of such a machine to be steered by control means on the machine body which sense the cutting horizon of the cutter head with respect to the mineral seam and which, if necessary, adjust the position of the arm to maintain the cutter head on a desired cutting horizon.

The arm pivots about an axis normal to the direction of traverse so that any adjustment of the arm position results in a step being formed in the boundary currently being formed by the cutter head. If the cutter head is cutting adjacent to the lower seam boundary a step is left in the mine floor which affects the inclination of the conveyor when it is advanced towards the newly exposed working face. Unfortunately, the effect of the step on the inclination of the conveyor tends to vary depending upon several factors including whether the cutting horizon was raised or lowered. Such variations have tended to make automatic steering of ranging arm mining machines more difficult than mining machines having the cutter head fixed relative to the machine body. With the so-caled fixed cutter head machines, the cutting horizon of the cutter head is adjusted by rocking the whole machine about an axis parallel to the direction of travel of the machine along the face. Such steering adjustments tend to vary the inclination of the formed boundary i.e. the mine floor, so that upon advance the conveyor tends to follow the smooth profile formed by the cutter head on sequential cutting traverses along the face.

An object of the present invention is to provide a ranging arm mining machine which tends to overcome the above mentioned problems.

According to the present invention a mining machine comprises a supporting underframe, a body assembly at least a portion of which is pivotally mountable relative to the supporting underframe for pivotal movement about a first axis, at least one cutter carrying arm pivotally mounted on the body assembly for movement about a second axis transverse to the first axis, first means for pivoting the said portion of the body assembly relative to the underframe and second means for pivoting the arm relative to the said portion.

Preferably, the said portion of the body assembly comprises a cutting end gearbox.

Advantageously, the cutting end gearbox is pivotally supported at its ends in trunnion bearing supports.

At least one of the trunnion bearing supports may be mounted on the supporting underframe.

Conveniently, at least one of the trunnion bearing supports may be mounted on a further portion of the body assembly which is not pivotally mountable relative to the supporting underframe.

Advantageously, both the two said portions of the body assembly comprises inclination means to sense the inclination of the associated portion.

One preferred embodiment of the present invention will be described with reference to the accompanying drawings in which.

Figure 1:
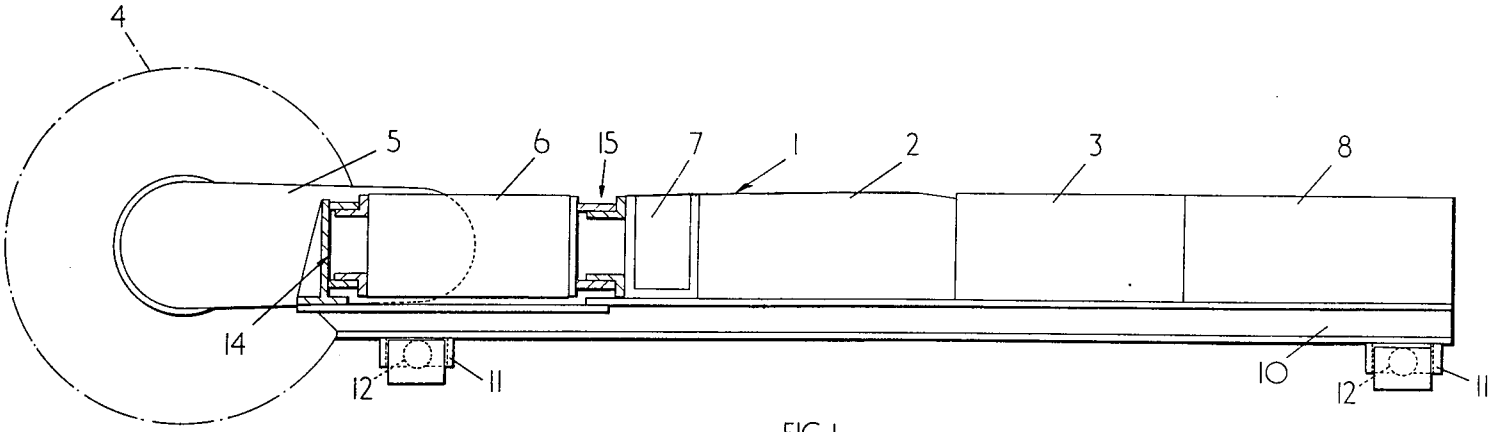
FIG. 1 is a side view of a ranging arm mining machine constructed in accordance with the present invention.

Referring to the drawings, the ranging arm mining machine comprises a body assembly 1 including an electric motor portion 2 fed with power via flexible cables (not shown) and a steering control portion 3 which contains equipment for controlling the cutting horizon of a rotary cutter head 4 carried on an arm 5 pivotally mounted on a cutter-end gearbox portion 6 of the body assembly and drivably interconnected to the motor portion 2 via an intermediate gearbox portion 7. A haulage portion 8, drivably connected to the motor portion 2, is arranged to drivably engage a stationary haulage rope, chain or track (not shown) extending along the path of the mining machine.

The body assembly 1 is mounted on a supporting underframe 10 which has shoes 11 provided with rollers 12 for running engagement with an armoured conveyor 13 (see FIG. 2) extending along the machine's path. Portions 2, 3, 7 and 8 are fixedly mounted on the supporting underframe 10. The cutting-end gearbox portion 6 is pivotally mounted relative to the supporting underframe 10, the ends of the portion 6 being rotatably supported in a trunnion bearing support 14 mounted adjacent to one end of the underframe and a trunnion bearing support 15 mounted on the adjacent end of the intermediate gearbox 7. The trunnion bearing supports 14, 15 are shown partly in section in FIG. 1. Pivotal movement of the cutting-end gearbox portion 6 relative to the supporting underframe 10 is controlled by four hydraulic jacks 16 (see FIG. 3) mounted between the portion 6 and the underframe. The axis of pivotal movement of the portion 6 is transverse to the axis of pivotal movement of the arm 5.

The inclinations of the portions 3 and 6 are sensed by two inclination means 17 and 18 (see FIG. 3) provided in the portions 3 and 6, respectively. The inclination means may comprise, for example, a gravity based inclinometer which can measure the angle of the pivoted portion with respect to the fixed part of the machine or alternatively a position transducer which can measure the displacement of the pivoted portion with respect to the fixed part of the machine.

Signals indicative of the sensed inclinations are fed to to the steering control portion 3 which together with other sensed parameters including the position of the cutter head 4 relative to a boundary of the mineral seam, help the steering control equipment within portion 3 to maintain the cutter head along a desired cutting horizon. The inclination sensed by inclination means 17 is the inclination of the conveyor 13.

The drive for the rotary cutter head 4 is transmitted from the motor portion 2 via the intermediate gearbox portion 7 which has its output drive shaft co-axial with the rotational axis of the trunnion bearing supports 14 and 15. The drive is then fed via the cutting-end gearbox portion 6 and along the arm 5 to rotate the cutter head 4.

Figure 2:
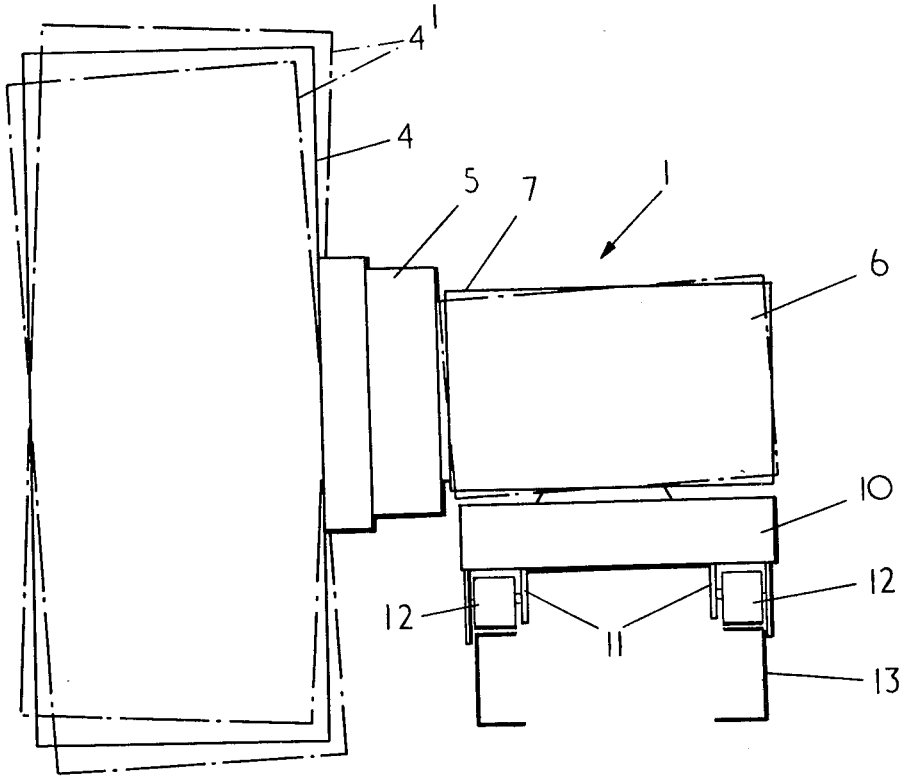
FIG. 2 is an end view of FIG. 1.
Figure 3:
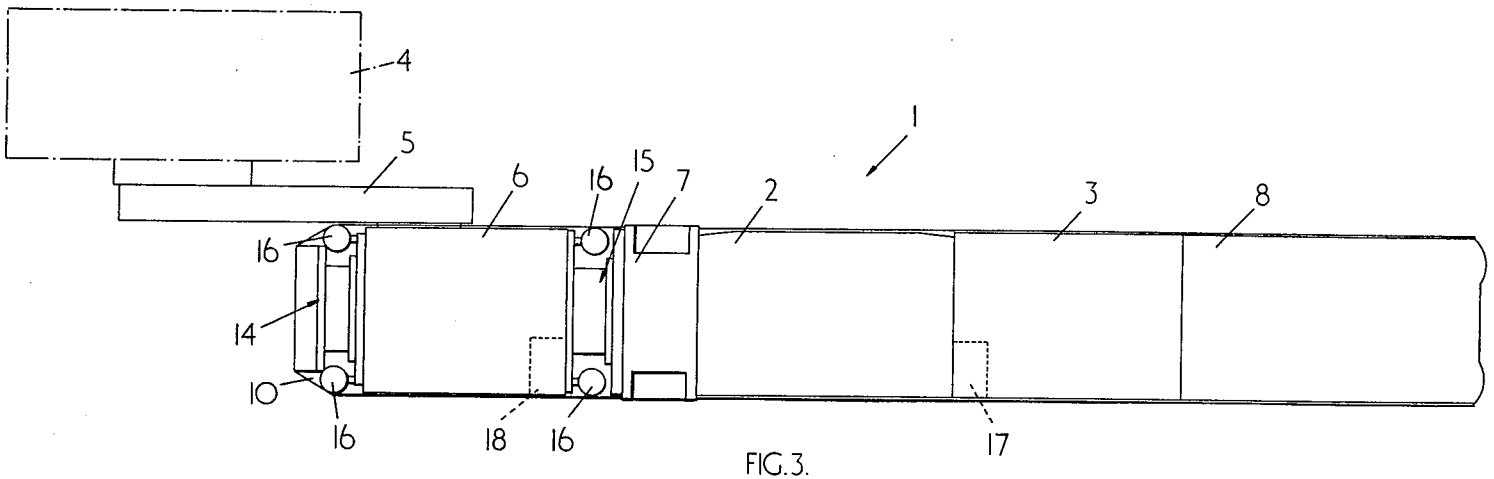
FIG. 3 is a plan of FIG. 1.

Adjustment to the position of the arm 5 is made by a hydraulic ram (not shown) acting between the adjacent portion of the body assembly 1 and the arm 5. The position of the arm 5 is adjusted when it is desired to raise or lower the cutter head between a position adjacent to the mine floor as shown in FIGS. 1, 2 and 3 to a position adjacent to the mine roof.

In use, as the machine traverses to and fro along a longwall mineral face, the arm 5 is releasably set in a desired raised or lowered position and steering adjustments to the cutter head are made by rocking the cutting-end gearbox portion 6 about the trunnion bearing supports 14 and 15 under the action of the rams 16 which are responsible to a signal fed from the steering control portion 3. Extent of the steering movement of the cutter head 4 is indicated in FIG. 2 by broken lines $4^1$. Thus, the mine floor formed by the cutter head on sequential cutting traverses tends to be smooth and without large steps. Consequently, the steering of the machine relative to the seam boundaries tends to be more predictable.

In modifications of the invention, the mining machine comprises two cutter head-carrying arms pivotally mounted on two cutting-end gearbox portions, respectively.

I claim:

1. A mining machine which in use traverses back and forth along a face conveyor extending along a working face, said machine comprising a supporting underframe movably engaging the conveyor, a body assembly supported by the supporting underframe and at least a portion of which is pivotally mounted relatively to the supporting underframe for pivotal movement about an axis extending generally in the direction of machine traverse, at least one cutter carrying arm pivotally mounted on said portion of the body assembly for movement about a second axis transverse to the direction of machine traverse, first means for pivoting said portion of the body assembly relative to the underframe and second means for pivoting the cutter carrying arm relative to said portion.

2. A machine as claimed in claim 1, in which the said portion of the body assembly comprises a cutting end gearbox.

3. A machine as claimed in claim 2, in which the cutting end gearbox is pivotally supported at its ends in trunnion bearing supports.

4. A machine as claimed in claim 3, in which at least one of the trunnion bearing supports is mounted on the supporting underframe.

5. A machine as claimed in claim 4, in which the other of the trunnion supports is mounted on a further portion of the body assembly which is not pivotally mountable relative to the supporting underframe.

6. A machine as claimed in claim 5, in which said first means for pivoting the cutting end gearbox comprises a plurality of hydraulic jacks mounted between the cutting end gearbox and the supporting underframe.

7. A machine as claimed in claim 6, in which said second means for pivoting the cutter carrying arm comprises a hydraulic ram acting between the body assembly and the cutter carrying arm.

8. A mining machine which in use traverses back and forth along a face conveyor extending along a working face, said machine comprising a supporting underframe movably engaging the conveyor, a body assembly supported by the supporting underframe and at least a portion of which is pivotally mountable relative to the supporting underframe for pivotal movement about a first axis extending generally in the direction of machine traverse, at least one cutter carrying arm pivotally mounted on said one portion of the body assembly for movement about a second axis transverse to the direction of machine traverse, first means for pivoting said one portion of the body assembly relative to the underframe, second means for pivoting the cutter carrying arm relative to said one portion, and inclination means to sense the inclination of said one portion.

9. A machine as claimed in claim 8, in which said inclination means comprises a gravity based inclinometer or a position transducer.

* * * * *